United States Patent [19]

Dunn

[11] Patent Number: 4,785,595

[45] Date of Patent: Nov. 22, 1988

[54] FIRE-RATED MAIN RUNNER

[75] Inventor: James J. Dunn, St. Charles, Ill.

[73] Assignee: Chicago Metallic Corporation, Chicago, Ill.

[21] Appl. No.: 150,239

[22] Filed: Jan. 29, 1988

[51] Int. Cl.[4] ..... E04C 2/52; E04C 2/42; E04B 5/52

[52] U.S. Cl. ..... 52/232; 52/484; 52/573; 52/729; 52/DIG. 5

[58] Field of Search ..... 52/232, 573, DIG. 5, 52/664–669, 484, 729

[56] References Cited

U.S. PATENT DOCUMENTS

| | | | |
|---|---|---|---|
| 3,159,252 | 12/1964 | Cotts | 52/664 |
| 3,175,655 | 3/1965 | Brown et al. | 52/573 |
| 3,284,977 | 11/1966 | Lickliter et al. | 52/573 |
| 3,350,125 | 10/1967 | Adams | 52/573 |
| 3,388,519 | 6/1968 | Downing, Jr. | 52/232 |
| 3,397,501 | 8/1968 | Jahn | 52/573 |
| 3,457,688 | 7/1969 | Znamirowske et al. | 52/573 |
| 3,496,690 | 2/1970 | Jahn | 52/232 |
| 3,589,089 | 6/1971 | Kedel | 52/573 |
| 3,778,947 | 12/1973 | Sauer | 52/232 |
| 3,807,111 | 4/1974 | Brady | 52/232 |
| 3,846,031 | 11/1974 | Adams | 52/573 |
| 3,890,760 | 6/1975 | Jones | 52/DIG. 5 |
| 3,965,631 | 6/1976 | Sauer | 52/232 |
| 3,965,632 | 6/1976 | Rousey | 52/232 |
| 4,016,701 | 4/1977 | Beynon | 52/573 |
| 4,128,978 | 12/1978 | Beynon | 52/232 |
| 4,208,851 | 6/1980 | Sauer | 52/573 |
| 4,598,514 | 7/1986 | Shirey | 52/232 |
| 4,601,153 | 7/1986 | Dunn et al. | 52/232 |
| 4,606,166 | 8/1986 | Platt et al. | 52/664 |
| 4,685,262 | 8/1987 | Meredith, Jr. | 52/232 |

OTHER PUBLICATIONS

Chicago Metallic Corporation sale brochure, Designer Ceiling Systems, 09120/CHI published in Sweet's Catalog, Feb. 1987.

*Primary Examiner*—James L. Ridgill, Jr.

[57] ABSTRACT

An expansion joint or fire break for a main runner which has a web portion interconnecting a bead having a rectangular cross section with a pair of outwardly extending flanges characterized by an aperture in the web portion, a portion of the bead above the web portion being deformed to provide a modified bead having a flattened portion of reduced width connected to an upper sub-bead portion of a greater width, three notches extending transversely through the upper sub-bead and the aperture having an arrangement including shear lines and cuts to define bending lines or regions for the web that extend through the notches of the sub-bead and to define three bending lines or areas for the flanges, which are aligned with the bending lines in the web. When the runner is subjected to elevated temperatures, the compressive forces formed by thermal expansion will be relieved by the modified bead and web buckling laterally outward with bending in the three bend regions as the flanges buckle downward with bending in three bend areas.

9 Claims, 1 Drawing Sheet

FIG. 1
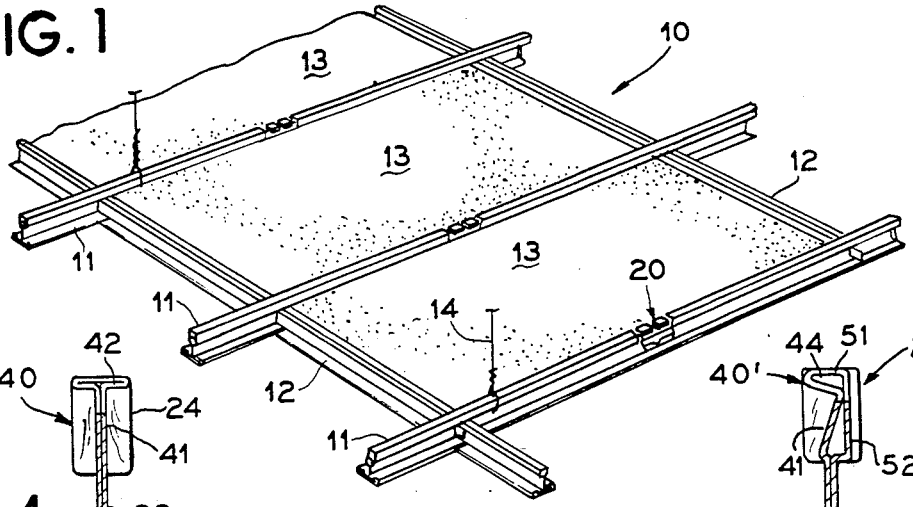
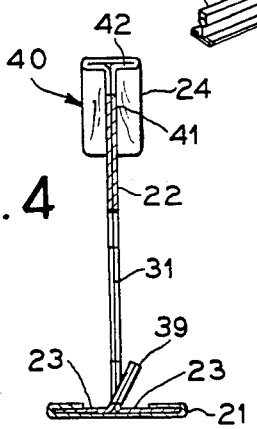
FIG. 4
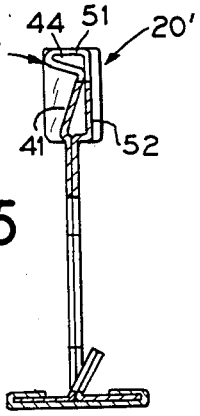
FIG. 5
FIG. 2
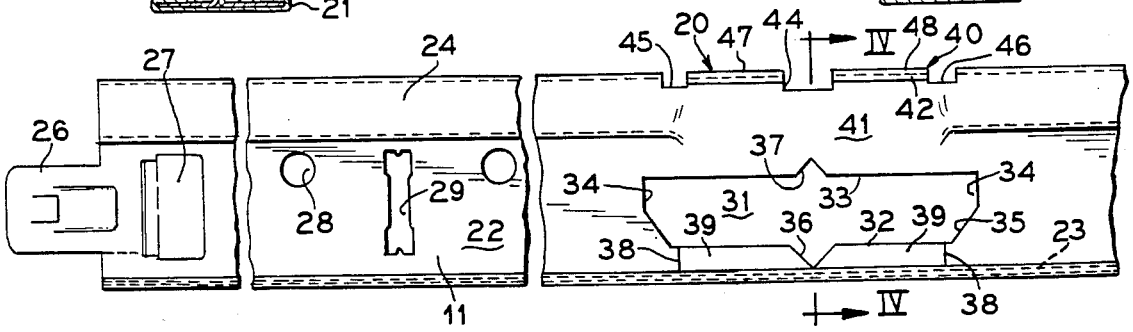
FIG. 3
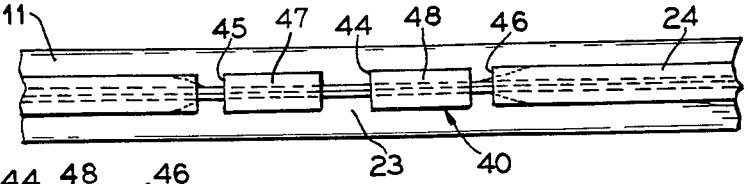
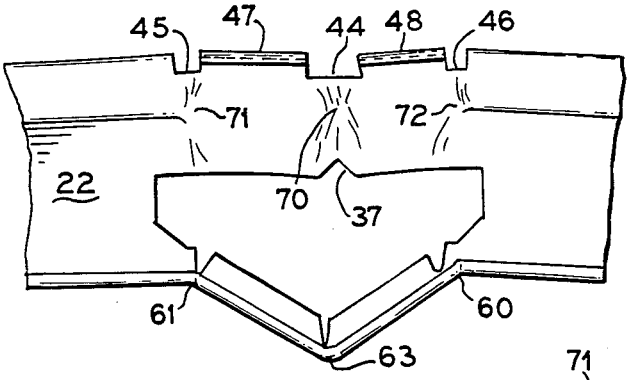
FIG. 6
FIG. 7
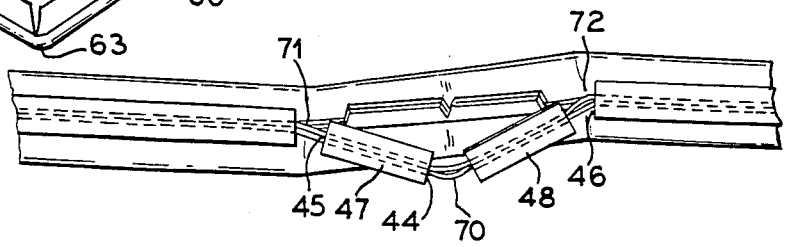

FIRE-RATED MAIN RUNNER

BACKGROUND OF THE INVENTION

The present invention is directed to a runner for use in a suspended ceiling system, which runner has an expansion joint to provide controlled buckling of the runner if subjected to elevated temperatures due to a fire.

To obtain a fire rating for a suspended ceiling section, various approaches have been taken for providing a runner with a fire-rated expansion section. An example is disclosed in U.S. Pat. No. 3,397,501, wherein a web has an elongated slot adjacent a bead with three spaced cuts extending into the bead from the slot and the web adjacent to the flanges has a second elongated cut so that when subjected to compressive forces the bead will buckle upward as the flanges buckle downward and the web between the two cuts buckles outwardly to one side. Similar proposals are disclosed in U.S. Pat. No. 3,589,089 and U.S. Pat. No. 4,601,153.

Other fire-rated runners have had an opening formed through the web of the runner adjacent the flange and have had the bead completely cut away above the opening so that the web and flange can buckle. Examples are disclosed by U.S. Pat. Nos. 3,159,252; 3,388,519; and 3,965,632.

Another approached for providing expansion joints in an inverted T member is to provide apertures in the webs and to crimp or deform a portion of the bead to aid in causing the bead to buckle. Examples are disclosed by U.S. Pat. Nos. 3,846,031; 3,965,631; 4,598,514; and 4,685,262.

Another type of fire-rated runner has cuts or slits in the web adjacent the flange and has a weakened bead due to either holes or removing portions of the beads. Examples are disclosed by U.S. Pat. Nos. 3,807,111; 4,016,701; and 4,128,978.

In the final catagory, the inverted T has portions of the webs removed adjacent the flange with a portion of the head being deformed and also a portion of the deformed bead being cut away to form a weakened area. Examples are disclosed in U.S. Pat. Nos. 3,778,947 and 4,685,262.

SUMMARY OF THE INVENTION

The present invention is directed to providing a runner with an expansion joint for a suspended ceiling system, which runner is easy to manufacture, will easily deform to relieve compressive stresses created by elevated temperatures of a fire and yet has substantial rigidity in normal use.

To accomplish these goals, the present invention is directed to an expansion joint for a runner. The runner has an inverted T configuration with a bead having one edge connected by a web portion to two outwardly extending flanges. The joint comprises a modified bead with an upper part and a lower part, the lower part being deformed inward to a reduced width to leave an upper part or portion of the bead with a greater width than the reduced width. The upper or outer portion has three spaced apart, transverse extending slots or notches cut therethrough to form three space locations for bending. The web portion has an aperture between the slots and the flanges, and the aperture has a length greater than the distance between the three slots so that when the runner is placed into compression, the web between the aperture and the bead will bend on each of the three bend lines to buckle outwardly to one side as the flanges adjacent the aperture buckle downward.

Preferably, the runner is formed by a single sheet of metal, which has a web with a double thickness extending up to a bead having a rectangular cross section, with the opposite ends of the web portions extending outwardly to form the flanges which are covered with a cap. Preferably, the aperture extends beyond the three slots and has an upwardly directed portion or cut and a downwardly pointed cut or portion in alignment with the middle slot in the bead. In addition, the web has two shear lines extending from the aperture towards the flanges in alignment with the outer two notches, which shear lines act to insure that the flanges buckle downwardly.

In one embodiment, the walls of the bead in the lower part has been forced inward into engagement with each other to form a cross section of a T. In a second embodiment, the collapsing of the bead collapses one wall more than the other so that in the area of collapsing, the upper portion of the modified bead will have a sub-bead of a triangular configuration with the bottom portion of the bead having a smaller width to promote bending. In each of the embodiments, a portion of the web between the flanges and the aperture and extending between the two shear lines is bent slightly out of the plane of the web. These edges coact with the edges of the web to prevent an upward buckling of the flanges.

BRIEF DESCRIPTION OF THE DRAWINGS

FIG. 1 is a perspective view of a top of a suspended ceiling system utilizing the runners of the present invention;

FIG. 2 is a side view of a portion of the runner, in accordance with the present invention;

FIG. 3 is a top plan view of the runner of FIG. 2;

FIG. 4 is a cross sectional view taken along lines VI—IV of FIG. 2;

FIG. 5 is a cross sectional view similar to that of FIG. 4 of an embodiment of the invention;

FIG. 6 is a side view of the runner after compensating for expansion; and

FIG. 7 is a top view of the runner of FIG. 6 after expansion.

DESCRIPTION OF THE PREFERRED EMBODIMENTS

The principles of the present invention are particularly useful in a ceiling system, generally indicated at 10 in FIG. 1. The ceiling system 10 has a plurality of main runners 11 with cross runners 12 that extend between the main runners and form openings which receive panels 13. The entire suspended ceiling system 10 is suspended by appropriate means, such as wires 14.

To be a fire-rated ceiling, the main runners must be provided with fire breaks or expansion joints so that a controlled buckling will occur to relieve compressive forces placed on the runners, due to elevated temperatures that occur from a fire in the space below the ceiling. The cross runners 12 also require an arrangement for relieving expansion forces, and these can be accomplished such as by the arrangement that occurs in U.S. Pat. No. 4,601,153.

However, each of the main runners is provided with an expansion joint or fire break, generally indicated at 20. If each of the runners is of 12 foot length, then, preferably, two fire breaks are provided for each of the runners.

Each of the runners, such as the main runner 11, have an inverted T configuration, as illustrated in FIG. 4, and are formed by a cap member 21 and a piece of sheet metal which is bent to form a double-wall web 22, which has two outwardly extending flanges 23 and, at the opposite side, has a bead 24, which has a rectangular configuration. To complete the runner, the cap 21 is applied and crimped onto the two flanges 23. While the runner is illustrated as being a runner having a narrow flange which has a total width of the combined two flanges of approximately 9/16", other flange widths could be used.

The runner 11, at its end, has a conventional splicing means which, as illustrated, includes a tongue 26 and strap abutment arrangement 27, which coact with tongues and strap abutment arrangements of another runner to splice two runners together. In addition, the web 2 may have openings, such as 28, which will receive wires, such as 14, for suspending the runner and has slots 29 for receiving tongues of the cross runners 12.

As best illustrated in FIGS. 2, 3 and 4, the expansion joint or fire break 20 includes an aperture 31, which has a lower edge 32 spaced above the flanges 23 and an upper edge 33 which runs into edges 34 at each end. The end edge 34 has a sloping portion 35 which connects the edge 34 to the lower edge 31. The lower edge 32 has a V-shaped notch or cut 36, while the upper edge 33 has a V-shaped notch or cut 37, which substantially lie on a common vertical line. A portion of the web extending between the lower edge 32 and the flanges 23 is sheared at shear lines or cuts 38, 38 to form web tabs 39, 39 which are separated by the V-shaped notch 36. The web tabs 39, 39, as best illustrated in FIG. 4, are shifted out of the plane of the web 22.

The bead 24 immediately above the aperture 31 has a modified portion, generally indicated at 40. The modified portion or bead 40 has a lower portion or part 41 immediately adjacent the lower edge of the bead adjacent the web 22 that is pressed inward so that the modified bead 40 has a T configuration with the pressed inward portions 41 terminating in a T-shaped flange or upper part 42 (see FIG. 4). The pressed-in portion 41 extends approximately between two vertical lines defined by the shear lines 38. The T portion, or upper part or portion 42 is cut by three notches or slots with a center or middle notch 44 lying on the vertical line formed by the V-shaped notches 36 and 37. The other two or outer slots 45 and 46 lie vertically above the shear lines 38, 38 and approximately at the end of the deformed lower portion 41. The three notches or slots 44, 45 and 46 divide the upper part of the modified bead into two segments or portions 47 and 48. In other words, in the vicinity of the outer slots 45 and 46, the deformed portion 41 starts to return to the normal, rectangular cross sectional configuration of the bead 24. It should be noted that both the notches 45 and 46, as well as the deformed portion 41, has a spacing less than the length of the upper edge 33 of the aperture 31. Thus, the end edges 34, 34 are outward of the deformed portion and the outer notches 45 and 46.

An embodiment of the expansion joint is generally indicated at 20' in FIG. 5. In this embodiment, the major difference is that a deformed portion 41' of the modified bead 40' has had the two vertical portions of the bead's wall pressed towards each other to form an upper sub-bead 51, which has a substantially triangular configuration, and a lower sub-bead 52. The lower sub-bead 52 has a width which is substantially less than the width of the sub-bead 51. However, the walls of the sub-bead 52 are not in complete contact with each other for the full height of the sub-bead. As in the modified bead 40, three spare notches, such as middle notch 44, extend through the sub-bead 51 to weaken the sub-bead 51 and divide it into to spare segments or portions similar to segments 47 and 48.

In a suspended ceiling 10, which is subjected to elevated temperatures due to a fire in the enclosure, each of the main runners 12 will have the fire break or the expansion joint, whether it is the joint 40 or 40', react to allow for a controlled buckling of the runner, as illustrated in FIGS. 6 and 7. The object is that the control buckling will permit relieving of the compressive forces due to the thermal expansion in the runner without causing the runners to twist and, therefore, drop or release the panels, such as 13.

As illustrated in FIGS. 6 and 7, each of the tab portions, such as 39, that extend between the shear lines 38 and are separated by the V-shaped notch 36, will buckle downwardly with the flanges bending adjacent each of the shear lines, as indicated by the bends 60 and 61. In addition, the flanges will bend at the area of the lower V-shaped notch 36 to form a bend, such as 63. As the flange is bending in bending areas or points 60, 61 and 63, the modified bend 40 of the bead 24 and its adjacent web will bend in a region defined by the notch 44 and upper V-shaped notch 37 to form a bend 70. In addition it will bend in regions adjacent each of the outer two notches 45 and 46 to form bends 71 and 72. These bends 70, 71 and 72 allow relief of the compressive forces being applied on the web 22 and also on the bead 24 of the main runner. As illustrated, the bends in the flange, as well as the bends in the bead and web, allow the remaining portion of the runner to remain substantially unaffected due to buckling in the localized area of the expansion or fire break 40.

The modified fire break or expansion joint 40' will function in approximately the same manner when subjected to the compressive forces. It should be noted that the use of the shear line, such as 38, to form the tabs 39, insures that the tabs bend downward, as illustrated in FIG. 6, and not upward. It is also noted that the notches, such as 44, 45 and 46, along with the notch 37, form weakened portions for the modified bead so that the modified bead can bend at these portions.

It should be noted that the modified bead still maintains some rigidity until subjected to these compressive forces. Thus, the structure is such that the load characteristics of the runner are not affected by the presence of the fire break, because the modified bead will still maintain some of the rigidity to prevent deflecting of the runner in the vertical direction due to the loads being supported thereon.

As mentioned hereinabove, both of the expansion joints 40 and 40' can be formed in existing runners by approriate use of dies to flatten or deform a lower part or portion, such as 41, of the bead to obtain the modified bead 40, and also with dies or punches to cut the various notches, such as 44, 45 and 46, while also cutting the apertures 31 and forming the shear line, such as 38.

Although various minor modifications may be suggested by those versed in the art, it should be understood that I wish to embody within the scope of the patent granted hereon all such modifications as reasonably and properly come within the scope of my contribution to the art.

I claim:

1. An expansion joint for a runner, said runner having an inverted T configuration with a hollow bead having one edge connected by a web portion to two outwardly extending flanges, said joint comprising a portion of the bead being modified with a lower portion of the area of the modified bead having walls being deformed inwardly to a reduced width relative to the walls of the upper portion of the modified bead, said upper portion of the modified bead being sub-divided into two portions by a transverse middle notch and transverse outer notches on each side of the middle notch, an aperture being formed in the web in the region of the modified bead, said aperture extending along the runner a greater distance on each side of the outer notches and approximately to the end of the deformed lower portion, said aperture having means for defining three bend areas in the flange, said means coacting with the notches in the upper portion of the bead to form three bend regions for the web and modified bead so that when the runner is placed under compression due to a fire, the modified bead and a portion of the web will buckle outwardly with bending at said three bend regions and the flange immediately adjacent the aperture will buckle downward with bending at the three bend areas.

2. An expansion joint according to claim 1, wherein the modified bead has an upper sub-head with the lower portion of the bead having at least a portion of the walls of the bead in contact with each other.

3. An expansion joint according to claim 1, wherein the means of the aperture for forming bend areas includes a V-shaped cut extending downward towards the flange in vertical alignment with the middle notch of the modified bead and a shear line in alignment with each of the outer notches.

4. An expansion joint according to claim 3, wherein the means for forming bend regions includes a V-shaped cut formed by the aperture adjacent the lower portion of the modified bead in alignment with the middle notch in the bead and the V-shaped cut extending towards the flange.

5. An expansion joint according to claim 1, wherein the walls of the lower portion of the modified bead are deformed into engagement with each other to leave a T-shaped cross section for the modified bead.

6. An expansion joint according to claim 5, wherein the means includes a V-shaped first cut in an upper edge of the aperture in alignment with center notch, a V-shaped second cut in a lower edge of the aperture in alignment with the first cut and the center notch, a pair of shear lines in alignment with the two outer notches.

7. An expansion joint according to claim 6, wherein a portion of the web between the pair of shear lines is deformed out of the plane of the web.

8. A fire-rated suspended ceiling system having a plurality of main runners and cross runners, each of said runners having an inverted T configuration with a bead along an upper edge of the runner connected by a web portion to two outwardly extending flanges, each of the main runners having at least one expansion joint, said expansion joint comprising an aperture extending through the web between the flanges and bead, said aperture having means defining a first bend region in the web and flanges and means defining two second bend regions on the opposite sides of said first bend region, said bead having a modified portion overlying the aperture with a lower part and an upper part, said lower part adjacent the web having side walls of the bead deformed inwardly to a width which is less than the width of the side walls of the upper part, said upper portion of each of the deformed beads having a transversely extending middle notch aligned with the means forming a first bend region and an outer notch on each side of the middle notch and aligned with the means forming the second bend regions, all of said notches extending through the upper part to from bend areas for the modified bead so that when the ceiling system is subjected to elevated temperatures because of a fire, each of the expansion joints will bend at the bend areas and bend regions to relieve the compressive forces applied to the runner.

9. A fire-rated suspended ceiling system according to claim 8, wherein the means defining a first bend region includes a cut in each of the upper and lower edges of the aperture and the means defining two second bend region being a pair of shear lines extending in the web from the lower edge toward the flanges.

* * * * *